United States Patent [19]

Andersen

[11] 3,954,213

[45] May 4, 1976

[54] TURN BAR APPARATUS AND METHOD FOR WEB FED ENVELOPE MACHINE

[75] Inventor: Egil A. Andersen, E. Dennis, Mass.

[73] Assignee: United States Envelope Company, Springfield, Mass.

[22] Filed: Dec. 23, 1974

[21] Appl. No.: 535,295

[52] U.S. Cl. ..... 226/7; 226/97; 226/197; 226/199

[51] Int. Cl.[2] ..... B65H 23/32

[58] Field of Search ..... 226/97, 180, 189, 197, 226/199, 1, 7

[56] References Cited

UNITED STATES PATENTS

| | | | |
|---|---|---|---|
| 3,542,621 | 11/1970 | Calhoun | 226/197 X |
| 3,657,974 | 4/1972 | Hedrich | 226/197 X |

*Primary Examiner*—Richard A. Schacher
*Attorney, Agent, or Firm*—Richard L. Schamalz; Vernon F. Venne

[57] ABSTRACT

Apparatus and method are disclosed for adjusting the entry angle of a continuous web into an envelope-making machine. The entry angle of the web is capable of adjustment even though web supply roll, printing means, splicer, and other equipment normally located before the feed end of an envelope making machine are stationary and not attached to the envelope-making machine. The apparatus for adjusting web angle includes a first turn bar unit; a plate attached to the body of the envelope-making machine near the feed end of the machine, which can swivel about a point, the means of attachment being the point about which the plate swivels; and a second turn bar unit attached to the swivel plate. As the web advances into the first turn bar unit it is flat. The first turn bar unit turns the web so that as it moves from the turn bar unit it is on its edge or in edgewise orientation. The web remains on its edge as it enters the second turn bar unit. After passing through the second turn bar unit the web is again in a flat orientation. With the web on its edge the swivel plate is capable of being moved so as to permit the entry of the web into the envelope-making machine at desired angles. The adjustment of web angle is achieved without movement of any equipment except the swivel plate and without damage to the web.

8 Claims, 6 Drawing Figures

10
12
14
16
18
19
21
22
30
31
32
34
36
38
40
42
44
45
50
60
61
62
71
72
80
81
A
B
C
D

TURN BAR APPARATUS AND METHOD FOR WEB FED ENVELOPE MACHINE

BACKGROUND OF THE INVENTION

1. Field of Invention

This invention relates in general to advancing material of continuous length and the guidance of the moving material by means of turn bars in association with other means. More particularly this invention pertains to apparatus and method for continuously advancing a web of material from which envelopes may be fabricated in association with means which permit the angle of entry of the web into an envelope-making machine to be easily adjusted. The apparatus includes turn bar units which guide the web from an initial flat position to an edgewise orientation and then back to the original flat position before entry into an envelope making machine. The second of the turn bar units is attached to a swivel plate. Adjustment of the plate changes the angle at which the flat web enters the envelope machine.

U.S. Pat. No. 3,599,851 is representative of the prior art teaching relative to turn bars, although the teaching is not directed toward the use of turn bars in association with an envelope-making machine.

2. Description of the Prior Art

Machines for rapid manufacture of envelopes from a continuous web are known in the art. One such machine for the making of envelopes from diamond or rhombic shaped blanks is described in U.S. Pat. No. 2,696,255 issued to Heywood. When it is desired to manufacture a different size of envelope, it is necessary to change the angle at which the web enters the cutting means or sheeter knife of the envelope-making machine. This change in web entry angle results in the cutting of a diamond-shaped blank having required size and outline so that when it is folded, it will form the desired new envelope. Previously, it was necessary that the web move in a straight line from the web source to the cutting means of the envelope machine in order to prevent damage to the paper web. Thus, to change the web entry angle to that required, the web supply had to be moved.

As the process associated with this type of envelope-making machine became more elaborate, more equipment was positioned between the web supply and the feed end of the envelope machine where the sheeter knife is located. Thus, for each change in envelope size it became necessary to move the web supply and other equipment located before the sheeter, so that the web could travel in a straight line. In order to eliminate moving each piece of equipment individually, it became the practice to attach all this equipment to the swivel plate of the envelope-making machine. This made it possible to cut blanks of various sizes by moving all of the equipment at the same time.

The above practice of attaching the heavy equipment to the swivel plate of the envelope-making machine also proved unsatisfactory. Any process involved in changing the size of the diamond-shaped envelope blanks was laborious and time consuming, due to the weight and cumbersome nature of the equipment. Accordingly, a long felt need in the art of envelope machine has been apparatus capable of adjusting the angle of the web entry into the cutting means of an envelope-making machine, but which eliminated the necessity to move the heavy equipment used to operate on the web before it entered the feed end of the envelope-making machine. It has also been desired to eliminate the practice of attaching the web source, printer and splicer to the swivel plate of the envelope-making machine. In addition, it is necessary that these problems be remedied without any damage occurring to the paper web.

BRIEF SUMMARY OF THE INVENTION

In view of the aforementioned problems it is the object of this invention to provide apparatus and method capable of adjusting the angle at which a web enters the sheeter or web cutting means located at the feed end of an envelope-making machine. The change of web angle is accomplished without damaging the web in any manner. The novel apparatus also eliminates the practice of attaching the web supply, splicer, printer, etc., to the swivel plate of envelope-making machine.

The stated object has been achieved by novel apparatus which includes a set of turn bar units. Briefly, the apparatus has an initial turn bar unit which takes a flat advancing web and turns it so that upon leaving the unit the web is advancing on its edge. The web advances on its edge to a second turn bar unit where the web is turned from its edgewise orientation back to its initial flat position. The second turn bar unit is associated with a swivel plate. The setting of the swivel plate determines the angle at which the web enters the envelope-making machine. The angle of entry of the web into the envelope making machine is defined by the path at which the web is travelling as it enters the cutting means of the machine in relation to the path at which the web originally traveled as it entered the first turn bar means of the invention. The swivel plate rotates about a point at which the plate is attached to the machine. This point is on the center line of the envelope-making machine.

The first turn bar unit which is independent of the swivel plate, consists of a horizontal roller with which the advancing flat web makes initial contact. The web is directed from the horizontal roller to a cross bar. The cross bar is at a 45° angle to the horizontal roller. The web is flat as it approaches the 45° cross bar. As the web makes contact with the 45° cross bar it begins to turn until when it leaves the bar it is in edgewise orientation. The web advances from the cross bar to a vertical roller which is the last part of the first turn bar unit. The vertical roller functions to change the direction of the advancing web.

The web advances on its edge to a second turn bar unit. The web first initially contacts a vertical roller. The vertical roller changes the direction of the web movement and directs the web still on its edge to a cross bar. The cross bar is at a 45° angle to the vertical roller. The web advances into contact with the cross bar and is turned from its edgewise orientation until the web is flat as it moves away from the cross bar. The web advances to a horizontal roller which changes the direction of its advance, but the web retains its flat orientation as it moves from the horizontal roller and to the feed end of the envelope-making machine at which point the cutting means are located. The web is traveling in a path which is at an angle to the path of the web as it entered the first turn bar unit.

The second turn bar unit is attached to a swivel plate. By moving the swivel plate the angle at which the web enters the envelope machine can be adjusted to that desired. (The swivel plate is attached to the feed end of the envelope-making machine.) The point at which the swivel plate is attached to the body of the envelope-making machine and about which the swivel plate pivots is located on the center line of the envelope-making machine. The position of the pivot point insures that a diamond or rhombic blank of uniform dimensions is cut from the web.

The purpose of each of the turn bar units is to change the orientation of the advancing web. The web is initially flat as it approaches the first turn bar unit. As the web advances from the first turn bar unit its orientation has been changed and the web is moving on its edge (edgewise orientation). The second turn bar makes initial contact with the web while the web has edgewise orientation. As the web moves from the second turn bar unit to the cutting means of the envelope-making machine it is flat.

In this disclosure when the web is said to have a flat orientation it is meant that the web is either advancing with its surface parallel to the horizontal or the web is moving upward or downward with respect to the horizontal. What is meant by flat can be visualized by drawing a line which would connect two points exactly opposite one another on the sides or edges of the web. When this line is parallel to the horizontal the web is defined as being flat.

When the web is described as traveling on its edge or as having an edgewise orientation it is again helpful to visualize a line connecting two points exactly opposite each other on the sides or edges of the web. This line will be perpendicular to the horizontal when the web is on its edge, that is to say, has an edgewise orientation.

Some care should be exercised in distinguishing between a flat orientation and an edgewise orientation. This is especially true when the web is moving upwardly or downwardly with respect to the horizontal. If the technique described above is used, it will be found that the line connecting the opposite sides of the web is parallel to the horizontal when the web moves upwardly or downwardly. Thus for purposes of the disclosure the web is defined to be flat when in either of these positions.

DESCRIPTION OF THE PREFERRED EMBODIMENT

Figures 1, 2, 3:
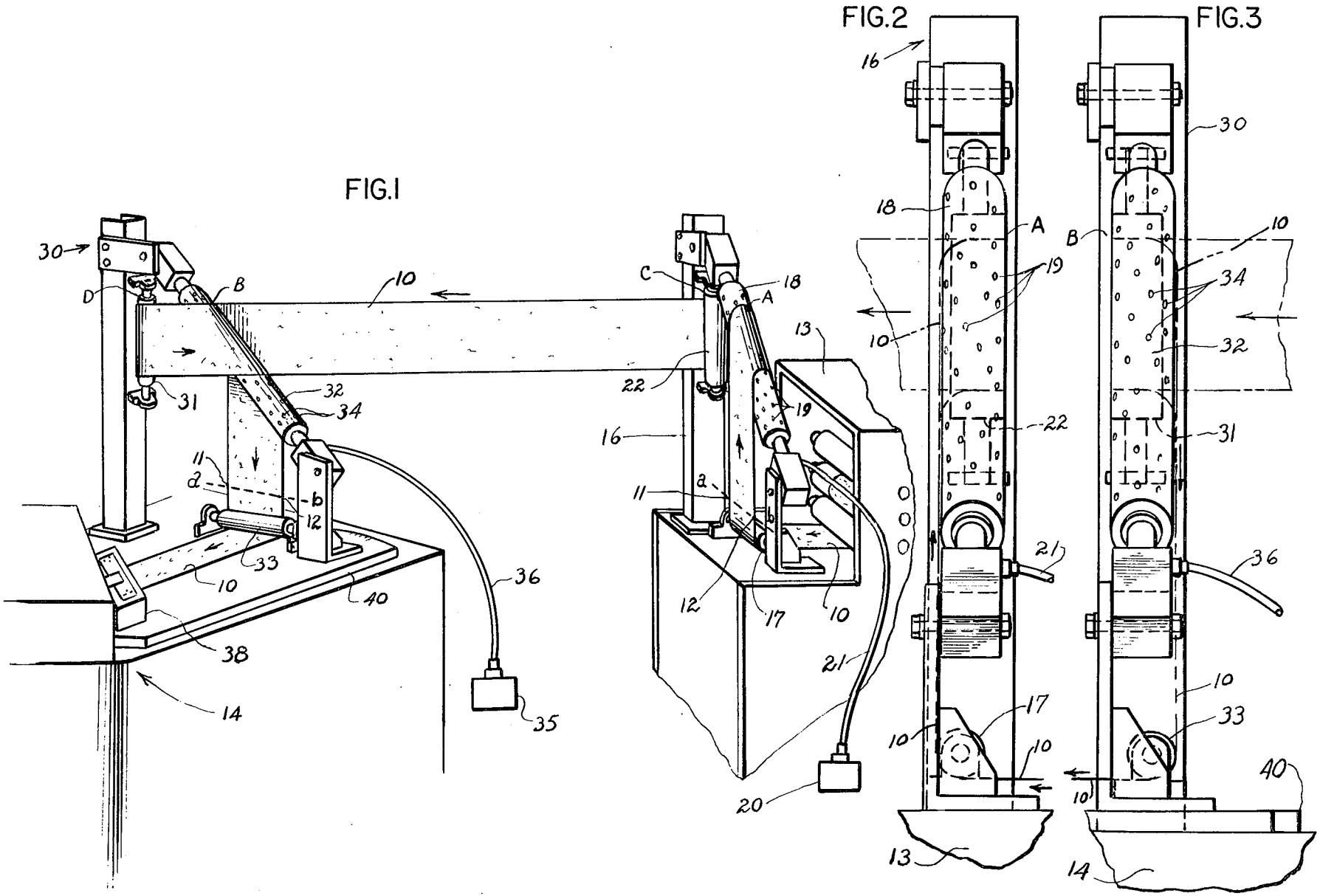

Referring to FIG. 1, the continuous paper web 10 is shown as it exits from a printer 13 and proceeds to an envelope-making machine 14. Although not shown, it should be clear that web supply roll, splicer, etc., are or can be located before the printer 13.

The web 10 is flat as it leaves the printer and advances to a first turn bar unit 16. As the web advances to the turn bar unit 16 it first contacts a horizontal roller 17, an element of the turn bar unit 16. As the web 10 moves away from the horizontal roller 17, it is an upwardly advancing web 10, but is yet unturned. As has been discussed, the web 10 is still said to be flat at this time. This can be seen by drawing a line to connect two points at opposite sides or edges 11 and 12 of the web 10. This line, *a—b*, is parallel to the horizontal and is therefore considered to be flat.

The web 10 advances from the horizontal roller 17 to a cross bar 18. The function of the cross bar 18 is to turn the web 10 so that as the web 10 moves from the cross bar 18 it is on its edge i.e. the web 10 has an edgewise orientation as opposed to a flat orientation. It can be seen that the web 10 has assumed an edgewise orientation by again visualizing a line connecting the edges 11 and 12 of the web 10. As can be seen, this line, *a–b*, is now perpendicular to the horizontal. The line, *a–b*, is shown removed from the cross bar 18 of the first turn bar unit 16 for reasons of clarity. However, it can be appreciated that the web has assumed an edgewise orientation as it leaves the cross bar 18 of the first turn bar unit 16. See FIG. 4. The cross bar 18 of the turn bar unit 16 is at a 45° angle to the horizontal roller 17. The cross bar 18 and the horizontal roller 16 are tangent at the point where the web leaves the horizontal roller 17 and first contacts the cross bar 18. The cross bar 18 may be and preferably is provided with a plurality of holes 19 through which air can be blown. The air forms a bearing about the cross bar 18 and allows the web 10 to move easily as it turns about the cross bar 18 since most friction is eliminated. The air is provided to the cross bar 18 from any conventional source 20 by means of a tube 21 or any other means of conveyance known in the art.

As the web 10 moves from the cross bar 18 it is in edgewise orientation. The web 10 advances on its edge until it contacts a vertical roller 22 the last element of the first turn bar unit 16. The vertical roller 22 serves as a point about which the web 10 can change direction while it is advancing on its edge, i.e. when line *a–b*, is perpendicular to the horizontal. The cross bar 18 and the vertical roller 22 are tangent where the web 10 leaves the cross bar 18 and first contacts the vertical roller 22.

The web 10 moves from the first turn bar unit 16 and advances on its edge to a second turn bar unit 30. The web while still in an edgewise orientation makes initial contact with a vertical roller 31. The vertical roller 31 functions to change the direction in which the web 10 is advancing and direct the web 10 to a cross bar 32. The cross bar 32 is at a 45° angle to the vertical roller 31. The vertical roller 31 and the cross bar 32 are tangent to each other at the point the web 10 leaves the vertical roller 31 and the point where the web first contacts the cross bar 32. As stated, as the web 10 advances to the 45° cross bar 32, it is on its edge. The web 10 contacts the cross bar 32 and is turned so that as the web 10 leaves the cross bar 32 it is no longer on its edge. The web 10 as it moves from the cross bar 32 is advancing downwardly and is flat. Once again it can be seen that the web 10 is flat by the drawing of a line connecting opposite edges 11 and 12 of the web 10. The line, *a–b*, is parallel to the horizontal and the web 10 is therefore defined as being flat. The web 10 advances from the cross bar 32 to the last element of the second turn bar unit 30 a horizontal roller 33. The horizontal roller 33 changes the direction of the web's 10 movement. The web 10 advances downwardly as it contacts the horizontal roller 33. When the web 10 leaves the horizontal roller 33 it is flat and advancing along the horizontal to the sheeter knife 38 located at the feed end of the envelope-making machine 14. The cross bar 32 is provided with a plurality of holes 34 through which air can be blown. As with the cross bar 18 of the first turn bar unit 16 the air forms a bearing about the cross bar 32 and reduces the friction between the cross bar 32 and the web 10. Air is supplied for a conventional source 35 normally by means of the tube 36.

The second turn bar unit 30 is attached to a swivel plate 40. The swivel plate 40 is positioned at the front or feed end of the envelope making machine 14. The point 42 at which the swivel plate 40 is attached to the machine 14 and about which the plate 40 turns corresponds to the center line 44 of the envelope-making machine 15. The swivel plate 40 can be attached to the body of the envelope-making machine 14 by any conventional means. It is standard practice to simply bolt the plate 40 to the machine 14 at the point 42 about which the plate 40 must pivot or turn.

Figures 4, 5, 6:
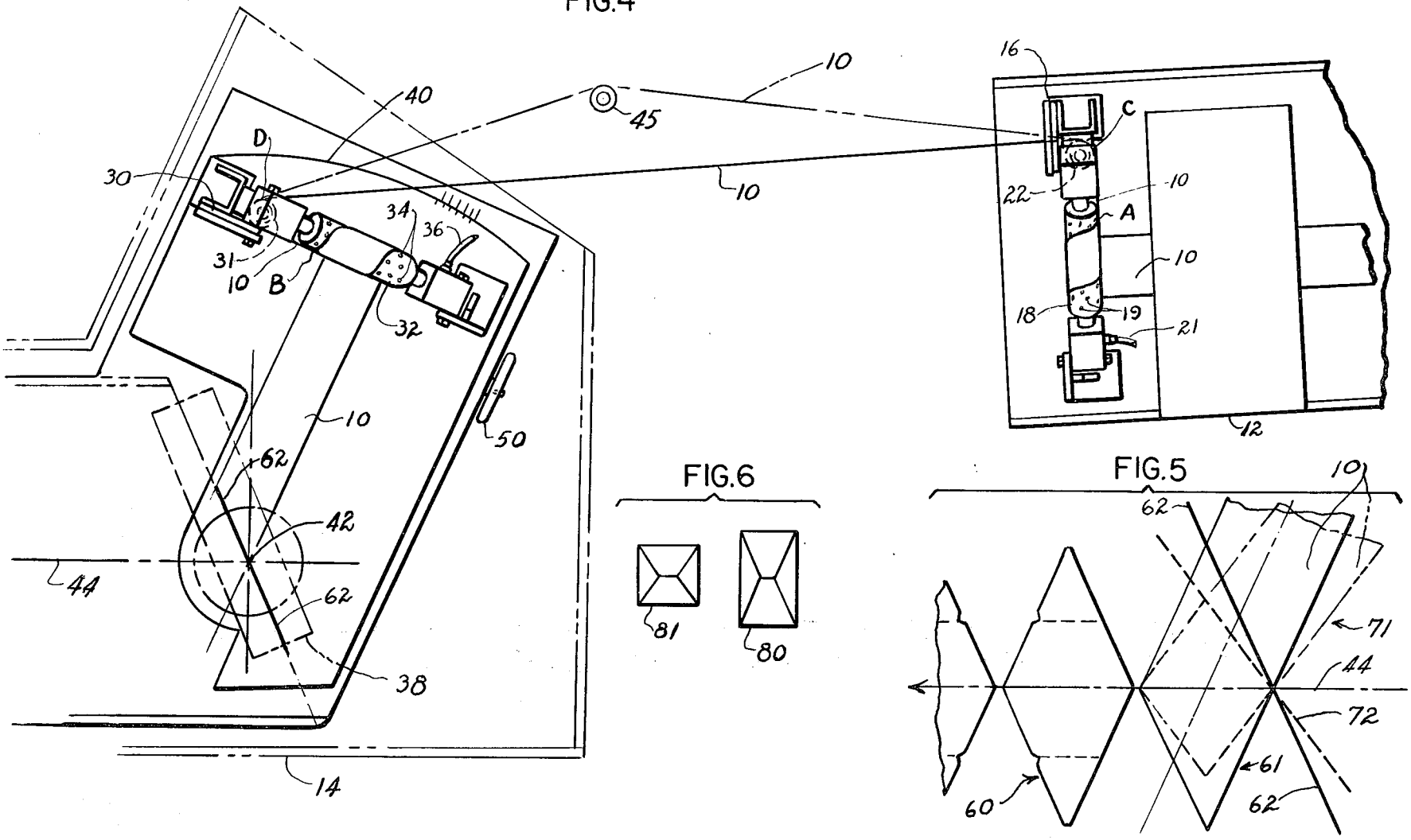

FIG. 4 is a top view of the web turning apparatus of the invention as shown in FIG. 1. The cross bar 18 of the first turn bar unit 16 turns the web 10 from its initially flat orientation until the web 10 is oriented on its edge as it leaves the cross bar 18. Thus it can be easily seen from this view that when the web 10 leaves the cross bar 18 of the first turn bar unit 16 at a point designated A the web 10 is on it edge or in an edgewise orientation. The web 10 advances on its edge until it makes contact, at a point designated B, with the cross bar 32 of the second turn bar unit 30. At all points between A and B the web 10 is moving on its edge.

It is notable that while the web 10 is advancing on its edge its route can easily be changed without any damage to the paper web. That is to say, the web 10 need not travel in a straight line between the turn bar units 16 and 30. One such alternate path in which the web could travel is shown by the broken lines between points C and D in FIG. 4. A roller 45 is the customary means that are utilized to accomplish the modification of the web route.

The second turn bar unit 30 is mounted on a swivel plate 40. The swivel plate 40 is attached to the body of an envelope making machine 14. The swivel plate 40 pivots about the point 42 making machine. The point of attachment 42 corresponds to the center line 44 of the envelope making machine 14. Control means 50 for the adjustment of the swivel plate 40 can be provided. Such means for controling the movement of the swivel plate 40 are well-known in the art and do not form a part of the invention.

As the swivel plate 40 is moved it can be seen that the second turn bar unit 30 moves with the plate 40 since the unit is mounted thereon. The angle at which the web 10 enters the sheeter or cutting means 38 of the envelope-making machine 14 is thereby changed when the plate 40 is moved. The angle at which the web 10 enters the sheeter knife 38 is a factor determining the size and shape of the diamond blank 60 that is to be cut. Thus by correctly adjusting web entry angle the proper blank for making envelopes of different sizes and shapes can be cut.

The use of turn bar units 16 and 30 has eliminated the requirement that the web travel in a continuous straight line from the web supply means and other equipment such as a printer until it is finally cut at the sheeter knife 38. Once the web 10 is turned so that it assumes an edgewise orientation as it advances from the cross bar 18 the web 10 is capable of being directed along any path without damage to the web. If desired direction means can be provided between the vertical bar 22 of the first turn bar unit 16 and the vertical bar 31 of the second turn bar unit 30 to alter the path of the web 10. Since the second turn bar unit 30 is mounted on the swivel plate 40 adjustment of the plate will determine the path of the web 10 as it advances from the horizontal bar 33 of the second turn bar unit 30 to the sheeter 38.

Use of the turn bar units 16 and 30 in combination with the swivel plate 40 has also eliminated the practice of attaching the web supply, printer and splicer to the swivel plate 40. Movement of all this equipment, in some cases, weighing at least 7500 lbs., was previously required every time a change in blank size was necessary in order to produce an envelope of different specifications. As can be seen, the use of turn bar units 16 and 30 has eliminated this practice. Equipment that once was attached to the swivel plate 40 is now independent of the plate. This equipment can now be stationary as the means for web angle adjustment resides in turn bar units 16 and 30 in combination with swivel plate 40. The use of turn bar units 16 and 30 has rendered unnecessary the practice of aligning all equipment located before the feed end of the envelope-making machine 14 as determined by the path the web was required to travel based upon the entry angle of the web 10 as the web moved under the sheeter knife 38.

FIG. 2 is an illustration of the first bar unit 16. A horizontal roller 17 is an element of the turn bar unit 16. The horizontal roller 17 associated with the first turn bar unit may be and preferably is a roller which is free to rotate about its axis 16. An alternative structure which might be used in place of roller 17 is a bar through which air can pass similar or identical to cross bar 18. The horizontal roller 17 is not necessarily mounted on the equipment (web supply, printer, splicer) before the envelope-making machine but can be if desired. Whether the horizontal roller 17 is mounted on the preliminary equipment, or is provided with its own support means; it should be oriented so as to be essentially perpendicular to the direction of web travel as the web 10 advances from the web supply, splicer, and printer.

The second element of the first turn bar unit 16 is a cross bar 18. The cross bar 18 is the means which turns the web 10, changing its orientation from flat until it is on its edge. The cross bar 18 defines essentially a 45° angle with respect to the horizontal roller 17. The cross bar 18 is provided with means of reducing the amount of friction between the bar 18 and the surface of the web 10. Preferably holes 19 are provided along the surface of the cross bar 18 which will be in contact with the web 10. Air is blown into the body of the hollow cross bar 18 and exits via the holes 19. The air is provided by means of any conventional air source 20 and is transferred from the source 20 to the cross bar 18 by means of a tube 21. Instead of holes a porous material may be utilized in the area at which the bar 18 contacts the web 10 and air blown through this material.

A vertical roller 22 is the third element of the turn bar unit 16. The function of the vertical roller 22 is basically to direct the web 10 along a desired path. It is preferred that vertical roller 22 be positioned in relatively close proximity to the cross bar 18 of turn bar unit 16 with which it is associated. It should be noted that any number of vertical roller can be positioned in the space between the two turn bar units 16 and 30. This is in recognition of the fact that once the web 10 has been turned so that it assumes an edgewise orientation the path of the web 10 can be changed as desired without damaging the web in any manner. One such path is illustrated by the broken lines between C and D in FIG. 4. It is also possible to eliminate the vertical roller 16 if the web 10 is able to move directly to the second turn bar unit 30.

It should be noted when reference to a "roller" is made in this disclosure that a cylindrical shaped body which is free to rotate about its axis is meant. In the preferred embodiment the roller will be an idler roll. However, the rollers used in the invention could be provided with conventional drive means if desired. When reference is made to a "bar" a body cyclindrical at least at the surface which contacts the web, which is stationary and not free to rotate is described. For this invention the bar is a hollow tube capable of having air circulating through its interior and exiting at openings provided through the body of the bar for reasons previously mentioned. As previously discussed, the turn bar unit 16 itself has three elements: one horizontal roller 17 and one vertical roller 22, and one cross bar 18 at a 45° angle to the roller 17 and 22.

The second turn bar unit 30 illustrated as FIG. 3 is nearly identical to the first turn bar unit 16 just described. The only critical difference between the units 16 and 30 is found at those points where the cross bar must be tangent to either the vertical or horizontal rollers. For the first turn bar unit 16 it is necessary that the surface of the horizontal roller 17 which the web 10 last contacts be tangent to the surface of the cross bar 18 with which the web will initially make contact. The surface of the vertical roller 22 of the first turn bar unit 16 with which the web 10 first makes contact must be tangent to that surface of the cross bar 18 with which the web 10 has last made contact.

The structure of the second turn bar unit 30 is slightly different. The surface of the vertical roller 31 with which the web 10 last makes contact must be tangent to the surface cross bar 32 with which the web 10 makes first contact as it advances. The surface of horizontal roller 33 that first touches the web 10 must be tangent to the surface of the cross bar 32 that last makes contact with the advancing web 10. If the cross bar and both rollers of each turn bar unit are of equal diameter and aligned tangentially then each unit would be identical.

FIG. 5 illustrates the manner by which a change in web angle as it passes under the sheeter knife 38 results in the production diamond-shaped blank of different dimensions and outline. The difference in the size of the diamond-shaped blank leads to the production of envelopes of different sizes as the end product. By use of the turn bar apparatus of this invention the adjustment of web angle is easily accomplished without requiring any movement of equipment not an integral part of the envelope-making machine, and without damaging the paper web.

The diamond-shaped blank 60 is the result of a web entry angle and sheeter knife setting as shown by solid lines 61 and 62. A different web entry angle and sheeter knife adjustment is shown by broken lines 71 and 72. Lines 62 and 72 represent the blade of the cutting means 38. The setting indicated by broken lines results in the production of a diamond-shaped blank (not shown) of different dimensions and outline as compared to blank 60 formed when the web 10 enters at the angle represented by the solid lines.

FIG. 6 illustrates the final envelope product formed after diamond-shaped blanks such as the blank 60 have been folded and gummed. Envelope 80 is illustrative of the size of envelope which might be produced from blank like the diamond-shaped blank 60. Envelope 81 illustrates an envelope of different size than envelope 80 and is intended to represent the size of envelope likely to be produced from a web which enters the sheeter knife 38 at an angle such as that represented by broken line 71. The apparatus of this invention has made rapid the operation required to change blank size needed to produce envelopes of different size and eliminates the need to move any heavy equipment.

Other and further modifications apart from those indicated herein could be made within the spirit of this invention.

I claim:

1. Apparatus for adjusting the angle of entry of a continuous web into cutting means of an envelope-making machine, said machine having a center line, comprising:

A. A first turn bar unit comprising:
   a. horizontal means for directing the web to turnover means;
   b. turnover means for changing the orientation of a web from a flat orientation to an edgewise orientation, said turnover means essentially defining a 45° angle with respect to said horizontal means;

B. A second turn bar unit comprising:
   a. vertical means for directing the web to turnover means;
   b. turnover means for changing the orientation of the web from an edgewise orientation to a flat orientation, said turnover means essentially defining a 45° angle in respect to horizontal means;
   c. horizontal means for directing the web horizontally to the cutting means;

C. A movable swivel plate upon which said second turn bar unit is mounted and over which the web passes horizontally before the web is severed by the cutting means of the envelope-making machine;

D. A pivot point about which the plate moves, said pivot point being located on the center line of the envelope-making machine.

2. The apparatus of claim 1 wherein said first turn bar unit includes vertical means for directing the web from said 45° turnover means to said second turn bar unit.

3. The apparatus of claim 2 wherein said vertical and said horizontal directing means of the first and second turn bar units are rollers.

4. The apparatus of claim 3 wherein the 45° turnover means of the first turn bar unit and the 45° turnover means of the second turn bar unit are cross bars, said cross bars being hollow and provided with means for the passage of air from the inside of the bar to the surface of the bar at the area where the web contacts the bar.

5. The apparatus of claim 4 wherein the horizontal roller of the first turn bar unit and the cross bar of the first turn bar unit are tangent where the web last contacts the horizontal roller and first contacts the cross bar, and the vertical roller of the first turn bar unit and the cross bar of the first turn bar unit are tangent where the web last contacts the cross bar and first contacts the vertical roller.

6. The apparatus of claim 5 wherein the vertical roller of the second turn bar unit and the cross bar of the second turn bar unit are tangent where the web last contacts the vertical roller and first contacts the cross bar; and the horizontal roller of the second turn bar unit and the cross bar of the second turn bar unit are tangent where the web last contacts the cross bar and first contacts the horizontal roller.

7. Method for continuously introducing a web into cutting means of an envelope-making machine, said machine having a center line, a movable swivel plate and a pivot point about which said plate is adjustable, comprising:

a. advancing a web along a first path to first horizontal directing means;
b. directing the web to first turnover means for turning the web to edgewise orientation;
c. turning the web to an edgewise orientation;
d. advancing the web on its edge to vertical directing means; said vertical directing means being positioned on the swivel plate of the envelope-making machine;
e. directing the web to second turnover means for turning the web to flat orientation, said second turnover means being positioned on the swivel plate of the envelope-making machine;
f. advancing the web to second horizontal directing means said horizontal means being positioned on the swivel plate of the envelope-making machine;
g. directing the web into cutting means of the envelope-making machine along a second path, said second path being at an angle to said first path and said second path being at a desired angle in relationship to the center line of the envelope-making machine, said second path established by adjusting the swivel plate to a desired position by pivoting said plate about a pivot point said pivot point lying on the center line of the machine.

8. Method for continuously introducing a web into cutting means of an envelope-making machine, said machine having a center line, a movable swivel plate, and a pivot point about which said plate is adjustable, comprising:

a. advancing a web along a first path to first horizontal directing means;
b. directing the web to first turnover means for turning the web to edgewise orientation;
c. turning the web to an edgewise orientation;
d. advancing the web to first vertical directing means;
e. advancing the web on its edge to second vertical directing means, said second vertical directing means being positioned on the swivel plate of the envelope-making machine;
f. advancing the web to second horizontal directing means said horizontal means being positioned on the swivel plate of the envelope-making machine;
g. directing the web into cutting means of the envelope-making machine along a second path, said second path being at an angle to said first path and said second path being at a desired angle in relationship to the center line of the envelope-making machine, said second path established by adjusting the swivel plate to a desired position by pivoting said plate about a pivot point said pivot point lying on the center line of the machine.

* * * * *